United States Patent [19]

Vollhardt et al.

[11] Patent Number: 4,509,463

[45] Date of Patent: Apr. 9, 1985

[54] UPRIGHT APPARATUS FOR COOLING HIGH PRESSURE GASES CONTAINING A HIGH DUST CONTENT

[75] Inventors: Frohmut Vollhardt, Oberhausen; Heinz Haacker, Kreuztal-Ferndorf, both of Fed. Rep. of Germany

[73] Assignee: M.A.N. Maschinenfabrik Ausburg-Nürnberg Aktiengesellschaft, Fed. Rep. of Germany

[21] Appl. No.: 564,210

[22] Filed: Dec. 22, 1983

[30] Foreign Application Priority Data

Dec. 24, 1983 [DE] Fed. Rep. of Germany ..... 3248096

[51] Int. Cl.[3] ..... F22D 1/00

[52] U.S. Cl. ..... 122/7 R; 48/67; 48/77; 122/5; 122/32

[58] Field of Search ..... 122/32, 33, 6 A, 5, 122/7 R; 48/67, 77, 63, 64; 165/157

[56] References Cited

U.S. PATENT DOCUMENTS 4,328,007 5/1982 Rafael ..... 122/5 X 4,395,268 7/1983 Zabelka ..... 122/7 R X

*Primary Examiner*—Edward G. Favors

*Attorney, Agent, or Firm*—McGlew and Tuttle

[57] ABSTRACT

An upright apparatus for cooling high pressure gases with a high dust component includes a radiation/convection cooler with longitudinally extending heat exchanger elements and a convection cooler follows the radiation/convection cooler on the gas side. As distinguished from known devices for the cooling of high pressure gases, the apparatus provides a largely uniform distribution of the gas at the cooling elements and hence a uniform thermal load of the individual elements in the radiation/convection cooler. A uniform cleaning of these cooling elements and easy removal of the dust from the cooling surfaces of these cooling elements is made possible, in order thereby to ensure a good heat transfer. The radiation/convection cooler heat exchanger elements are combined in finned tube walls forming lanes between them, which walls extend from one inner wall section to the opposite inner wall section.

7 Claims, 7 Drawing Figures

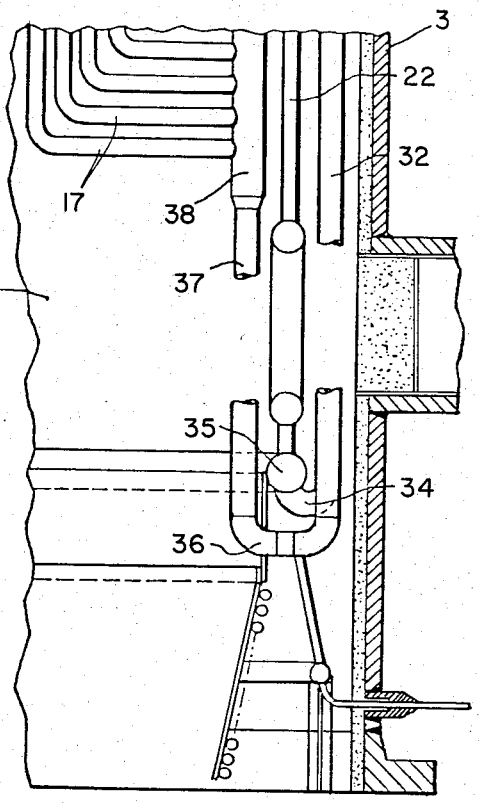
Fig. 5
Fig. 7
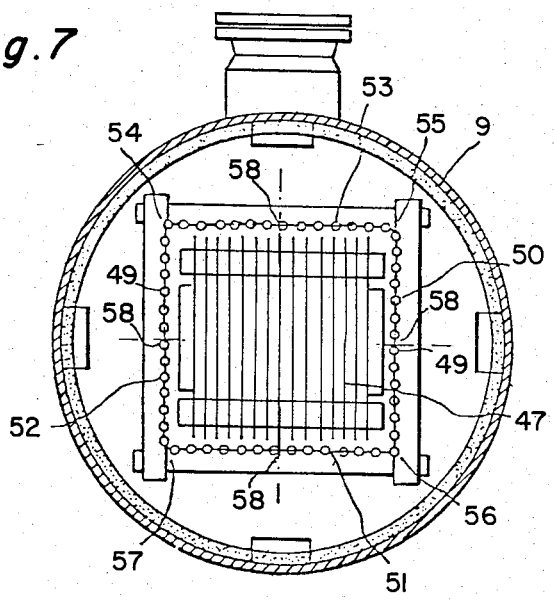

UPRIGHT APPARATUS FOR COOLING HIGH PRESSURE GASES CONTAINING A HIGH DUST CONTENT

FIELD AND BACKGROUND OF THE INVENTION

This invention relates in general to heat exchangers and in particular to a new and useful apparatus for cooling high pressure gases containing a high dust content.

From European Patent Document EU-OS No. 0 013 580 an apparatus for cooling high pressure gases is known which comprises a convection cooler provided with gas flow courses which on the gas side are connected one behind the other and are separated from each other by a longitudinal wall, and which are traversed by parallel conduits. Also coolers for high pressure gases with high dust component are known which are traversed by tube bundles without subdivision of their interior, the gas flowing through a manifold space at the upper section and through a header space at the lower section or vice versa.

SUMMARY OF THE INVENTION

As distinguished from these known devices for the cooling of high pressure gases, the invention provides an apparatus by which a largely uniform distribution of the gas at the cooling elements and hence a uniform thermal load of the individual elements in the radiation/convection cooler is achieved and further a uniform cleaning of these cooling elements and easy removal of the dust from the cooling surfaces of these cooling elements is made possible, in order thereby to ensure a good heat transfer. At the same time the design and construction of the apparatus is simple.

In accordance with the invention, an upright apparatus for cooling high pressure gases which contain a high dust content by radiation and convection is followed by a radation cooler on the gas side. The cooler comprises a vertically elongated housing defining an interior chamber with an inlet adjacent its top and an outlet for the gas adjacent its lower end. At least one heat exchanger is arranged in the chamber and it comprises a plurality of vertical finned tube walls arranged and spaced substantially in parallel rows forming gas path lanes therebetween and extending across the chamber from one side thereof to the other. Advantageously each finned tube row is provided with a connecting header at each end for connecting a coolant for flow through the tubes of the rows. The rows are advantageously arranged within a cylindrical finned tubed wall which surrounds them inside the chamber of the housing.

The advantage of the apparatus of the invention is to be seen in that, by the subdividing of the interior of the radiation/convection cooler into individual lanes separated from each other, provision is made that to each tube is correlated an equal, or approximately equal, flow cross-section of the gas in relation to the coolant pipes, regardless of whether the tube is located in the interior of the cross-section of the radiation/convection cooler or at its outer side. Also it is easier to clean the individual tubes on their outside from the lanes using simple cleaning equipments, whether blowing or brushing systems or the like, than when the tubes are arranged circularly around the cross-section center of the cooler. Further the stability (sturdiness) of a tube wall is greater than in the case of tube bundles formed by individual tubes.

Accordingly it is an object of the invention to provide an upright apparatus for cooling high pressure gases which contain a high dust component and which includes a radiation/convection cooler with longitudinally extending heat exchanger elements with a convection cooler following the radiation/convection cooler on the gas side and wherein the heat exchanger elements of the radiation/convection cooler are combined in finned tube walls forming lanes between them which walls extend from one inside wall section to the opposite inside wall section of the housing.

A further object of the invention is to provide a heat exchanger arrangement which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 5 is a partial section of the lower portion of the radiation/convection cooler in the detail V of FIG. 2;

FIG. 7 is a transverse section along line VII—VII of FIG. 6.

DESCRIPTION OF THE PREFERRED EMBODIMENTS

Figure 6:
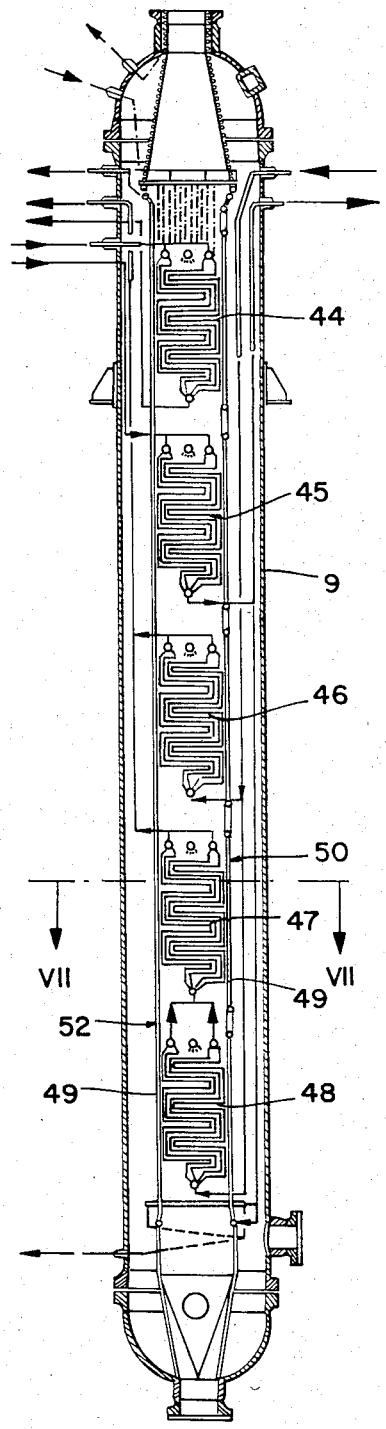
FIG. 6 is a longitudinal sectional view of the convection cooler and superheater following the radiation/convection cooler.

Referring to the drawings in particular the invention embodied therein comprises an upright apparatus including a radiation/convection cooler generally designated 3 which has an interior chamber which is vertically elongated and has an inlet line connection 2 for the inflow of high pressure gases to be cooled in the direction of the arrow 12 and an exit for the gases at the lower end at 4 which flow outwardly as indicated at 16 for passage to the convection cooler and superheater 9 as shown in FIG. 6.

In accordance with the invention the cooler interior chamber has at least one heat exchanger 17 comprising a plurality of vertically arranged finned tube walls 19 arranged in spaced substantially parallel rows forming gas lanes therebetween and extending across the chamber from one side to the other. The construction includes header means 38 and 39 connected to each tube row at each end of the row for connecting a coolant through the tubes.

The gas formed passes from the gas generator line 2 in the direction of the arrow 12 into the radiation/convection cooler 3, leaving it at its lower end at 4. Thence the gas flows via a line into a convection cooler and a superheater 9 (FIG. 6), in order then to leave the apparatus. The gas is under a pressure of about 5–50 bar, at a temperature of 800°–1000° C., and has a high dust component. The gas thus defined enters in the upper section of the radiation/convection cooler 3 into a manifold chamber 13 and traverses the central section 14, described in greater detail later, of the cooler 3, in order to be connected in the header chamber 15 and to leave the cooler 3 in the direction of the arrow 16.

Figure 3:
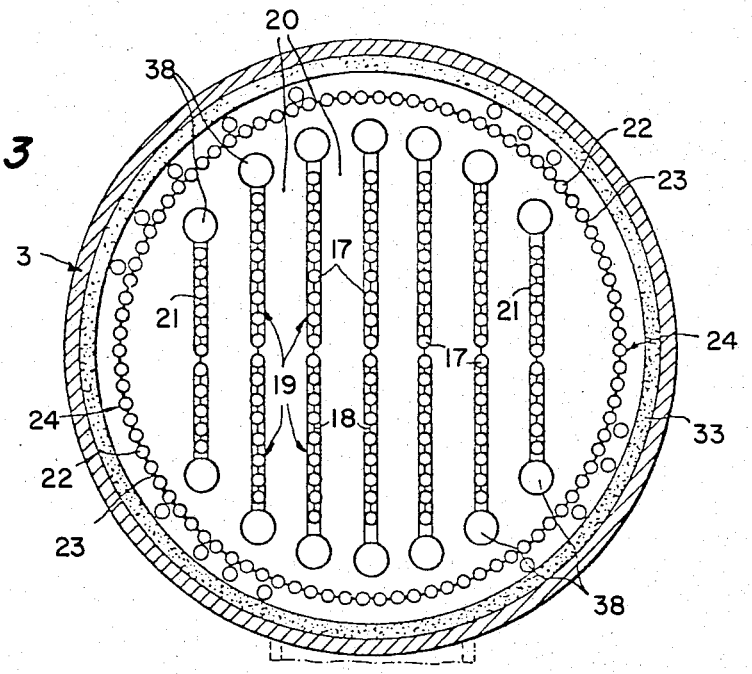
FIG. 3 is a section along line III—III of FIG. 1.

The central section 14 of the radiation/convection cooler 3 is provided with exchanger tubes 17, which are combined to form vertical longitudinal rows, have fins or webs 18 between them, and form with the latter a finned tube wall 19. The finned tube walls are equidistant from each other and leave lanes 20 between them. Also the two last and shortest finned tube walls 21 have approximately the same distance from the exchanger tubes 22, which with their fins or webs 23 form a cylindrical finned tube wall 24 (FIG. 3).

The tubes 17 of the finned tube walls 19 forming the lanes 20 are bent outwardly in their upper section 25, that is, one half of all tubes of a tube wall is bent to one side, while the other half of the tubes is bent to the other side. The same is true of the lower section 26 of the tubes 17. The fins or webs 18 of each tube wall 19 extend by their upper end 27 to just below the upper bent sections 25, and the lower end 28 of the webs or fins 18 extends to above the lower bent sections 26 of the tubes 17. (The radiation/convection cooler shown in FIG. 1 extends over a height such that the chambers 13,15 represent only a fraction of the length of the tubes 17 and walls 19).

Figure 4:
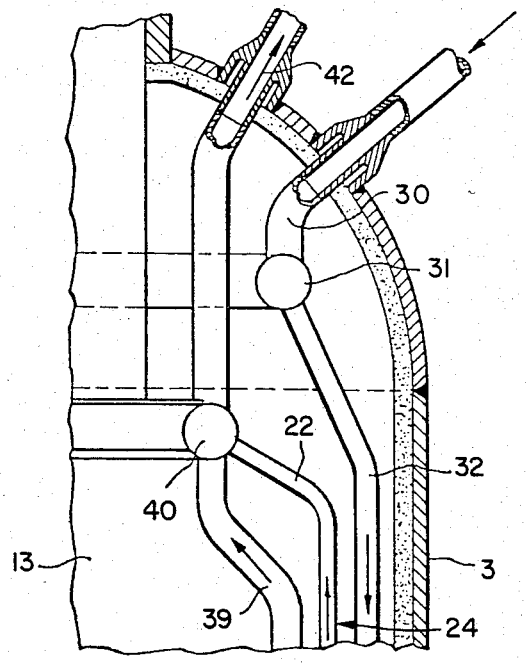
FIG. 4 is a partial section of the upper portion of the cooler according to FIG. 2 along the transverse section IV thereof.

The head 29 of the radiation/convection cooler 3 is traversed by coolant lines 30, which open into a manifold ring main 31. From it the coolant is distributed into the coolant down pipes 32 which extend between the insulating jacket 33 of cooler 3 and the cylindrical finned tube wall 24 (FIG. 4). At the lower end of the pipes 32 these pipes terminate via an elbow 34 jointly in a ring main 35 and via an elbow 36 into a line 37 for each with manifold section 38. The ring main 35 receives the tubes 22 of the cylindrical finned tube wall 24, while in the manifold section 38 of each pipe 37 the lower curved sections 26 of the tubes 17 of the finned tube walls 19 are inserted.

The upper curved sections 25 of the tubes 17 terminate in header sections 39 which, as do also the tubes 22 of the cylindrical finned tube walls 24, terminate in a common ring main 40, from which via lines 41 the now vaporous coolant is drawn in the direction of the arrows 42.

The cooled gas reaches the after connected convection cooler 9, which is of known design and in which the gas is guided along exchanger packets 44–48 in a meander-type arrangement. Parts of the cooler 9 may be designed as superheater. Preferably the tubes 49 limiting the interior space are likewise combined to form finned tube walls 50–53 (FIG. 7) which can be separated from each other along their longitudinal edges at 54–57 and turned about their longitudinal median axis 58, to obtain uniform wear of these walls.

Figures 1, 2:
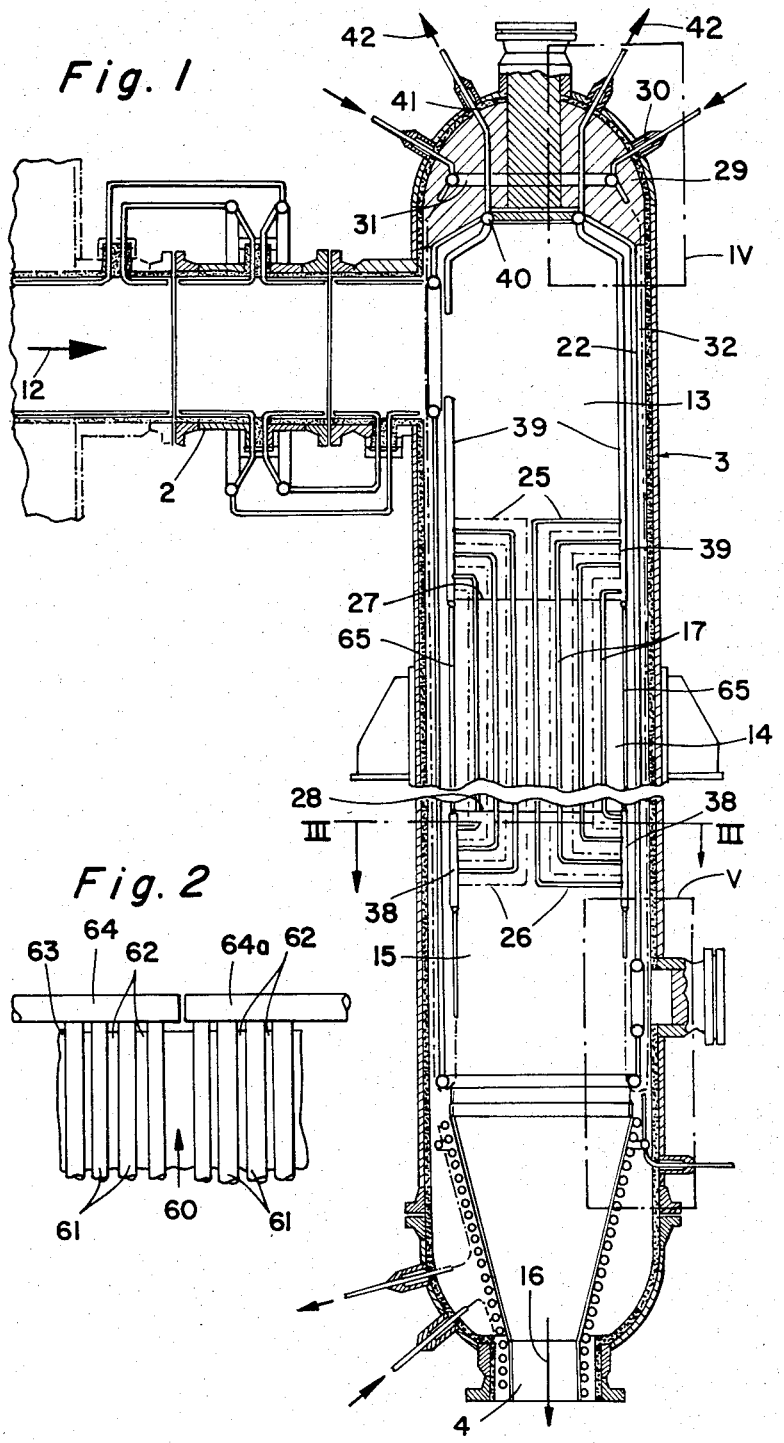
FIG. 1 is a longitudinal section through the radiation/convection cooler of the apparatus.
FIG. 2 is a detailed elevation of a further form of realization of the upper section of a finned tube wall.

In FIG. 2 is shown a form of realization of a finned tube wall 60 wherein the tubes 61 are of equal length and do not show bent end sections. The fins or webs 62 between the tubes 61 end at the same level at 63, so that the upper end of one half of the tubes 61 can open into a header pipe 64 for each, which in turn is inserted into the header sections 39 of FIG. 1. The pipes 64 extend to the longitudinal center of the walls 60. The lower end of the pipes 61 is designed in the same manner. There, too, the pipes 61 of equal length protrude into manifold pipes not shown, opening into the manifold sections 38. Also at the lower end, the webs end at the same level.

As can be seen from FIG. 1, there extends between the manifold section 38 and the header section 39 of each tube wall a pipe 65 of much thinner cross-section which forms a part of the respective tube wall.

From FIG. 3 can be seen further that the tube walls 19 have their longitudinal edges the same distance from the cylindrical finned tube wall 24 or respectively the header and manifold sections 38, 39 are equidistant from the cylindrical tube wall 24.

While specific embodiments of the invention have been shown and described in detail to illustrate the application of the principles of the invention, it will be understood that the invention may be embodied otherwise without departing from such principles.

What is claimed is:

1. In an upright apparatus for cooling high pressure gases containing a high dust component by radiation and convection, which apparatus is followed by a radiation cooler on the gas side, the improvement comprising a cooler housing defining a vertically elongated interior chamber with an inlet adjacent its upper end for the gas and a discharge for the gas adjacent its lower end, and at least one heat exchanger in said chamber comprising a plurality of vertical finned tube walls arranged in spaced substantially parallel rows forming gas pass lanes between said rows and extending across said chamber substantially from one side thereof to the other, and header means associated with said rows for connecting a coolant through said tubes.

2. In an upright apparatus according to claim 1, wherein said finned tube walls are flat and said lanes between said rows are of substantially equal width.

3. In an upright apparatus according to claim 1, including a cylindrical finned tube wall between said heat exchanger tube rows and the interior wall of said housing, the last of the rows at each end of said tube rows being spaced from said cylindrical finned tube wall by substantially equal amounts.

4. In an upright apparatus according to claim 1, wherein the upper and lower ends of the tube extend substantially horizontally in a direction toward the wall of said housing.

5. In an upright apparatus according to claim 1, wherein each of the tubes of each row are bent to extend substantially horizontally adjacent their upper and lower ends toward the wall of the associated housing which is the closest, said header means including at least one vertically elongated header connected to the tubes of each end of said finned tube walls.

6. In an upright apparatus according to claim 1, wherein said header means includes an inlet for coolant, said housing having a vertical down pipe for carrying the coolant from said inlet to the tubes of said finned tube wall, said down pipes being arranged annularly between said cylindrical finned tube wall and the interior of the wall of said housing, said interior wall of said housing including an insulation jacket.

7. In an upright apparatus according to claim 1, wherein said header means include a common horizontal header in which all of the tubes of said finned tube walls connect and including a cylindrical finned tube wall extending around said finned tube walls pass substantially parallel to the interior wall of said housing.

* * * * *